4-543 SW
10/15/85 OR 4,546,505

United States Patent [19]

Wakenshaw

[11] Patent Number: 4,546,505

[45] Date of Patent: Oct. 15, 1985

[54] PORTABLE SPA

[76] Inventor: John A. Wakenshaw, 109 Lake Rd., Box 1006, Tavernier, Fla. 33070

[21] Appl. No.: 601,074

[22] Filed: Apr. 16, 1984

[51] Int. Cl.[4] ..... A61H 33/02

[52] U.S. Cl. ..... 4/543; 4/544; 4/585; 4/588; 4/542

[58] Field of Search ..... 4/541-544, 4/573, 585-588, 601, 559; 128/65, 66

[56] References Cited

U.S. PATENT DOCUMENTS

| | | | |
|---|---|---|---|
| 2,541,029 | 2/1951 | Burton | 4/573 |
| 2,757,384 | 9/1956 | Slater | 4/601 |
| 2,907,051 | 10/1959 | Phillips | 4/585 |
| 3,092,101 | 6/1963 | Kinney | 4/541 |
| 3,251,071 | 5/1966 | Wood | 4/543 |
| 3,286,712 | 11/1966 | Roden | 4/544 |
| 3,373,451 | 3/1968 | Schmidt | 4/585 |
| 3,467,969 | 9/1969 | Szekely | 4/543 |
| 3,557,392 | 1/1971 | Schmidt | 4/585 |
| 3,755,830 | 9/1973 | Johns | 4/585 |
| 3,931,652 | 1/1976 | Navarra | 4/588 |
| 4,008,498 | 2/1977 | Thomas | 4/543 |
| 4,068,326 | 1/1978 | Deschler | 4/544 |

*Primary Examiner*—Stephen Marcus
*Assistant Examiner*—Linda J. Sholl
*Attorney, Agent, or Firm*—John Cyril Malloy

[57] ABSTRACT

A portable spa including a base platform sufficiently dimensioned to support one or more occupants and being of an inflatable structure capable of being expanded or collapsed for use or storage respectively. A containment wall is interconnected between the base platform and a support frame so as to define a contained space with the remaining components of the spa in which water may be circulated. Fluid directing jets are mounted on an exposed surface of the platform so as to provide a turbulent action within the water of the contained space. The support frame as well as other structural components of the spa may be collapsible so as to facilitate assembly and disassembly of the spa at any of a plurality of locations.

8 Claims, 10 Drawing Figures

PORTABLE SPA

BACKGROUND OF THE INVENTION

1. Field of the Invention

A portable spa having a plurality of structural components formed from an inflatable and/or rigid material and specifically structured to be easily assembled or disassembled wherein fluid regulating and directing means are included in the spa assembly so as to provide desirable turbulence to the water maintained in a contained space within the spa.

2. Description of the Prior Art

Spa assemblies, hot tub structures and like systems are well known in the prior art and have enjoyed increased popularity in recent years. In the majority of such systems, a contained space is at least partially filled with water which continuously is circulated throughout the contained space. A fluid directing structure is provided to include one or more jet streams of water directed into the interior of the contained space to create a certain amount of water turbulence.

In the conventional spa assembly or system, the tub or pool-like structure is generally formed of rigid material and permanently mounted or affixed either in-ground or above-ground at a specific location. Fixed plumbing in the form of rigid material conduits, pumps, valving, heating structures, etc. are then mounted at this given location in communication with the interior of the rigid material tub or pool to create the desired treatment of water being circulated. Again, while such substantially permanent systems are extremely popular, they are considered by many consumers to be somewhat expensive. Also, such structures do not readily lend themselves to relocation and placement at a variety of locations. Therefore, such prior art structures as described above are not generally adaptable to small living quarters or where there is not sufficient indoor or outdoor space to accommodate the aforementioned relatively permanent installation.

The prior art structure as described above are represented in the following U.S. Pat. Nos. to Janosko, 4,233,694; Mandell, 4,339,833; and Bonner, 4,420,846.

In addition to the above, there are structures existing in the prior art which are effectively collapsible, easily storable, and therefore relatively portable for transport from one location to another. Such structures frequently are used as collapsible bathing tubs and include an inflatable structure which define a contained space in which water is placed after the structures have been inflated. While such collapsible devices are most certainly operable for their intended use, these structures are not adaptable for use as a spa wherein liquid is recirculated through a contained space by fluid directing means so as to provide intended turbulence within the water and further provide the relaxing and sometimes therapeutic affects such turbulence frequently accomplishes.

United States patents representing collapsible and/or inflatable structures as set forth above are disclosed in the following U.S. Pat. Nos. to Burrow, 2,504,646; Alvarez, 2,505,845; Shill, 4,197,838; and Browning, 4,312,084.

Accordingly, there is a need in the recreational industry for a portable and collapsible spa assembly capable of being located at any of a variety of locations and requiring no permanent installation and relatively little room for setup and use.

SUMMARY OF THE INVENTION

The present invention relates to a portable spa including an inflatable base means having sufficient length and overall dimension for positioning in supported relation to occupants within a contained space. The inflatability of the base means allows it to be readily assembled and disassembled for operative use and storage and/or transport to other locations as desired by the user. A containment means preferably in the form of a flexible containment wall made of a liquid impermeable sheet material extends about the periphery of the base means and upwardly therefrom into supported engagement with a support means. The latter support means includes a support frame which also may be disposed in substantially surrounding relation to at least a portion of the contained space. The contained space is at least partially filled with water wherein such water or liquid is recirculated therethrough by entering the contained space through fluid directing means and exiting the contained space through a drain structure. A fluid regulating means in the form of a pump, a drive motor, proper valving and a heater assembly serves to continuously direct a flow of water through the fluid directing means into the interior of the contained space an therefrom, through vent means, back to the recirculating pump.

The pump may be connected to a conventional supply of water such as a spigot, garden hose, hot water heater, etc. for initial filling of the contained space. Thereafter, the valving means is structured for the selective recirculation of the liquid throughout the contained space as set forth above. Further structural features of the present invention include the fluid directing means including a plurality of jet apertures formed in conduit means located or mounted on an exposed surface of the base means. The liquid from the pump means is directed through the plurality of apertures into the contained space to provide a certain amount of desirable turbulence in the liquid within the contained space and thereby provide its occupants with the benefits normally associated with such turbulence.

Further structural features of the present invention include the support frame comprising an inflatable structure formed of material having sufficient rigidity to be self-supporting and upstanding from the ground or floor or surface which is generally disposed to support the entire spa assembly. Such inflatable support frame includes an interior surface which may define at least part of the aforementioned containment means and thereby define the boundaries of the contained space in which the water is placed.

Another embodiment of the present invention includes the support frame formed of a rigid material such as molded plastic, chrome plated metal or other applicable material. In this embodiment, the rigid support frame is disposed in surrounding relation to an opening of the contained space and the containment means extends along a major length of the periphery of the base means and upwardly therefrom into overlapping and supported engagement with surrounding peripheral portions of the rigid support frame. A plurality of legs or like structures serve to position the rigid supporting frame in its upstanding position relative to the aforementioned supporting surface on which the entire assembly is placed.

In either embodiment of the present invention the various components including the base means, and in one embodiment the support frame, is made from an inflatable structure wherein assembly and disassembly of the various components of the spa is readily accomplished. The subject spa assembly is thereby portable and readily stored or transported between a number of locations as desired by the user.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
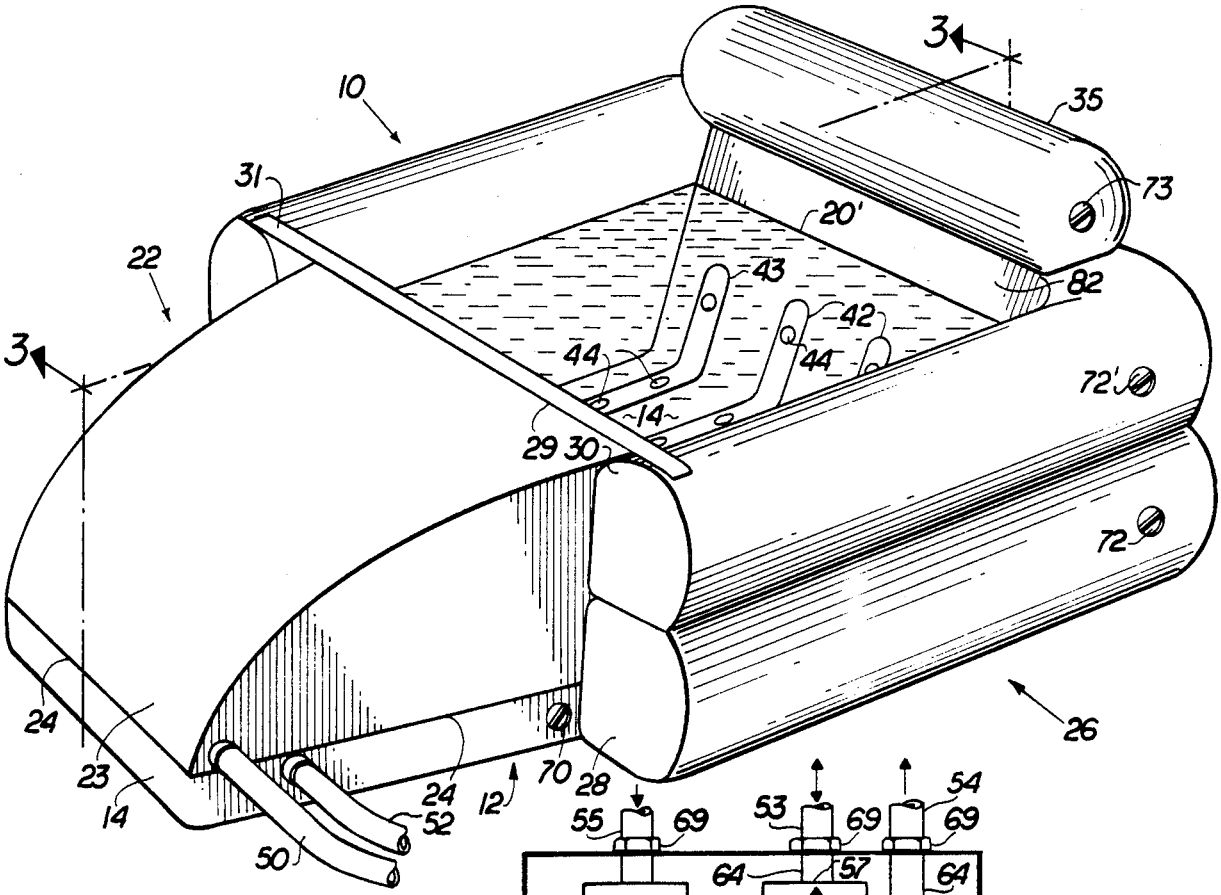
FIG. 1 is an isometric view of one embodiment of the subject spa assembly wherein the major components thereof comprise an inflatable structure.

As shown in FIGS. 1 through 4, the present invention is directed towards a spa assembly generally indicated as 10 and including a base means 12. The base means 12 is formed of an inflatable structure and has a sufficient overall dimension and configuration to serve as a supporting platform 14. The supporting platform has a substantially horizontal orientation when disposed on a supporting surface such as a ground, floor, etc. Further, the platform 14 comprises an exposed surface 16 which effectively defines the floor of a contained space 18. As will be described in greater detail hereinafter, the contained space 18 is at least partially filled with water 20 to a sufficient level 20' where occupants can enter the opening or entrance of the contained space (best shown in FIG. 1) without causing spillage of the water therefrom.

Figure 3:
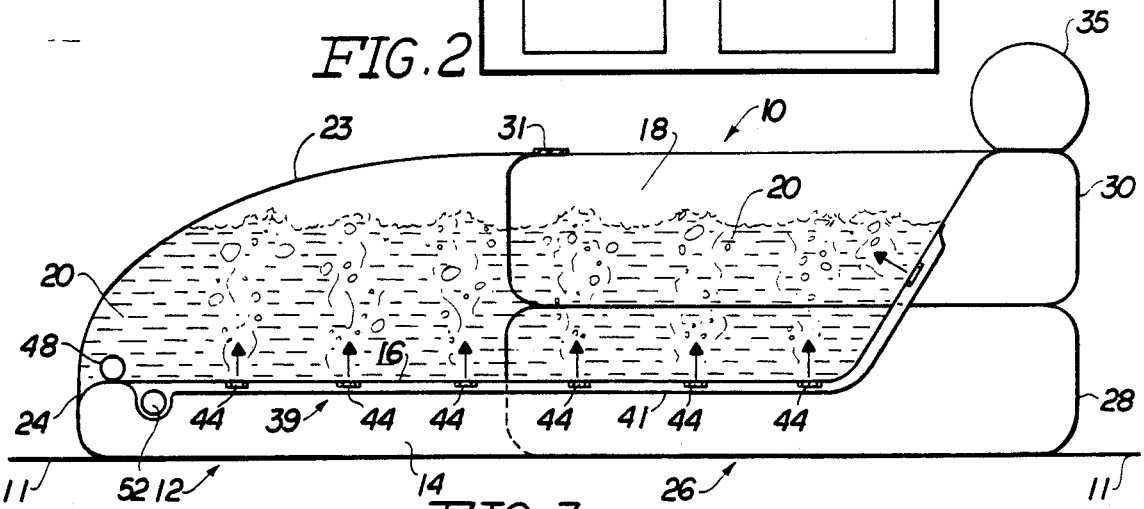
FIG. 3 is a view taken along line 3—3 of FIGS. 1 and 4 showing interior structural details of the various components as well as the contained space of the subject assembly.
Figure 4:
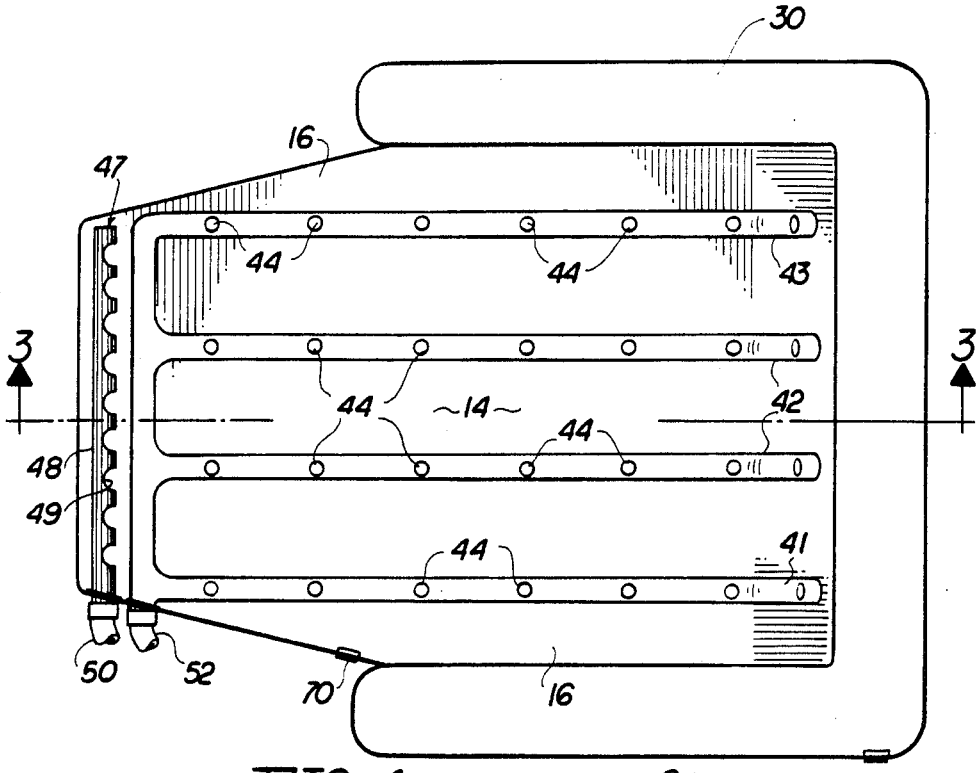
FIG. 4 is a top plan view of components of the embodiment of FIG. 1.

Again with regard to the embodiment of FIGS. 1, 3 and 4, the spa assembly 10 includes a containment means 22 preferably in the form on a containment wall 23 which may be substantially flexible and water impermeable and be attached to a peripheral portion as at 24 of the platform 14 or base means 12 and extend upwardly therefrom into supported engagement with support means generally indicated as 26. The support means 26, in the embodiment of FIGS. 1, 3 and 4 comprises an inflatable support frame having stacked sections 28 and 30. The support frame and its sections 28 and 30 are formed from a material having sufficient rigidity to be self-maintained in an upstanding position as shown in FIG. 1 and also of sufficient strength to provide supporting connection to a leading edge as at 29 of the containment wall 23. Such leading edge 29 may be connected by a connecting strap or adhesive tape element 31 wherein its opposite ends are removably adhered to the upper periphery of the inflatable section 30 of the support means 26. Further structural features of the embodiment of FIG. 1 include a neck support or bolster member 35 integrally or otherwise secured along an upper peripheral portion of section 30 so as to provide rest or support for the head and neck portions of occupants of the spa.

Figure 2:
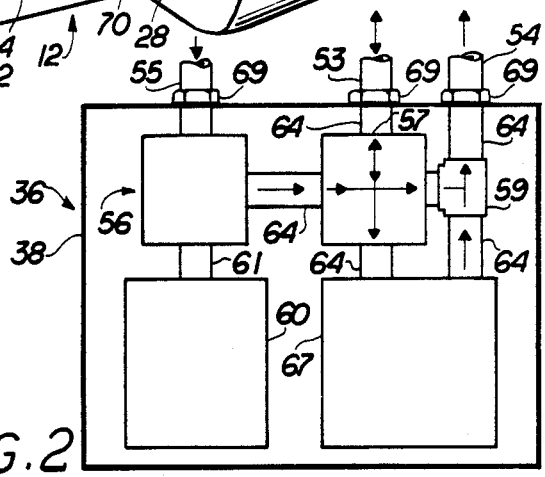
FIG. 2 is a schematic representation of the fluid regulating assembly associated with the subject spa so as to direct a heated liquid flow into and out of the contained space and provide proper liquid turbulence therein as desired.

With reference to FIGS. 2 and 3, the present invention further comprises a fluid regulating means (FIG. 2) generally indicated as 36 preferably mounted within casing 38 and specifically structured to direct liquid flow into and out of the contained space 18 in a manner to be described hereinafter.

A fluid directing means comprises conduit means generally indicated as 39 and including a plurality of conduits 41, 42 and 43 mounted on the exposed surface 16 in a predetermined configuration or array so as to cover a majority of the exposed surface 16. Each of the conduit portions 41, 42, and 43 include a plurality of jet apertures 44 specifically structured to force a jet or current of water therethrough as indicated by the directional arrows in FIG. 3. Further, each of the apertures 44 are mounted in cooperation with the conduit portions 41, 42 and 43 so as to direct the jet or stream of liquid into the interior of the containment means and provide proper turbulence (FIG. 3) within the contained space 18 as desired. A drain means 47 includes a drain pipe 48 having a plurality of liquid receiving apertures 49 formed therein wherein the drain pipe 48 is mounted on the interior of the contained space 18 in liquid communication with the water 20. Through interaction of both the fluid directing means 39 and the drain means 47, the water 20 is maintained in constant circulation and enters and leaves the contained space 18 at the same rate through cooperation of the above two set forth elements with the fluid regulating means to be described in greater detail hereinafter.

Water hose, pipe or like structure 50 serves to interconnect the drain pipe 48 to a pump inlet connection 55 which is disposed in direct liquid communication with the pump means generally indicated as 56. Further, a hose, pipe or like structure 52 is disposed in direct fluid communication with the outlet connection 54 which in turn is disposed in fluid communication with pump means 56 through valving structure 57 and 59.

Further with regard to FIG. 2, the fluid regulating means 36 comprises a drive motor 60 preferably being a two-speed motor interconnected in driving relation to the pump means 56 by appropriate power take-off or drive shaft 61. Plumbing in terms of connecting conduits 64 serves to interconnect the pump means with the valving structures 57 and 59 and the outlet and inlet connections 54 and 55 respectively. A supply inlet-outlet connection 53 may be interconnected through proper plumbing to a conventional water supply such as a hose, spigot, water heater, or the like when it is desired to fill the contained space 18. Alternately connection 53 may empty into a sink, conventional drain facility, etc. when it is desired to drain the entire contained space 18 and disassemble the spa 10.

Other features of the fluid regulating means 36 includes a heater means 67 which may be of the flow through type wherein electricla resistance coils or units serve to transfer heat to water passing through the heating means 67 from the pump means 56 and the appropriate valving structures 57 and 59. It should be noted however that the heater means 67 may include a number of commercially available structures which are either electrically, solar or gas operated.

In operation, the contained space 18 is filled by interconnecting inlet 53 to a conventional water supply. This incoming water is received by valving structure 57 which may be a multi-directional valve such that the water is directed from valving structure 57 through multi-directional valving structure 59 along appropriate connecting conduit 64 and from the fluid regulating means 36 through appropriate outlet 54. Outlet 54 is interconnected to the fluid directing means 39 and the individual conduits 41, 42 and 43 and the water passes through the plurality of jet apertures 44 into contained space 18. When filling, the drain means 48 is closed or blocked from allowing exiting of water therethrough in that the pump means 56 is not activated. Once filled to the desired level, the pump 56 is activated through operation of the two-speed drive motor 60 and drive shaft 61. Water is then drawn in through the drain means 47 and drain pipe 48 through inlet connection 55, and into the pump means 56. From the pump means 56 the water is at least partially forced through the first multi-directional valving structure 57 and into the heater means 67 for proper heating and/or temperature change. The water is then continuously forced from the heating means 67 through the second directional valving structure 59 and into the fluid directing means 39 through the outlet connection 54.

When it is desired to empty the water 20 from the contained space 18, the pump is driven at the lower second speed of the drive motor 60 and the valving structure 59 is closed such that water from drain means 47 entering inlet connection 55 and forced through pump means 56 is directed from the fluid regulating casing 38 through the valving structure 57 and directly out of outlet 53, bypassing the heater means 57 and of course the fluid directing means 39 leading back into the contained space 18.

The fluid directing means 36 also includes readily detachable connectors 69 structured for removably interconnecting respective inlets and outlets 53, 54, and 55 to the casing 38 in fluid communication with the pump means 56 and/or valving structures 57, and 59 as indicated above.

With regard to FIGS. 1, 3 and 4 as well as other embodiments of the present invention, certain structural features further include appropriately positioned air inlets 70, 72, 72' and 73 used to inflate the interior of the base means 12, support frame portions 28 and 30 and neck bolster 35 respectively. Such inflation may be accomplished through the use of conventional air pumps or like appliances. Each of these outlets include proper plug structures so as to prevent escape of air once the respective structures are properly inflated.

Figure 5:
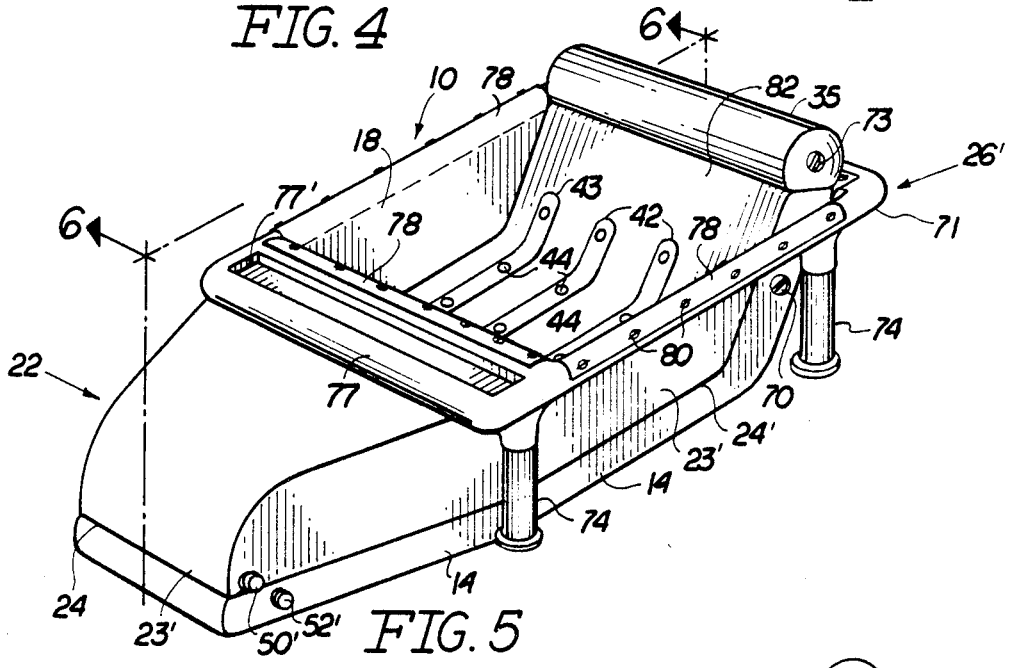
FIG. 5 is another embodiment of the present invention wherein a support frame thereof is formed of rigid rather than inflatable material.
Figure 6:
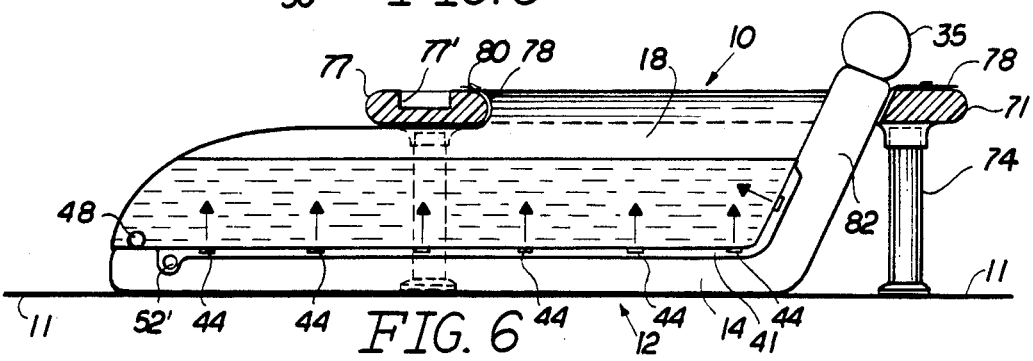
FIG. 6 is a sectional view taken along line 6—6 of FIG. 5.

As shown in FIGS. 5 and 6, another embodiment of the present invention cmprises a support means 26' defined by a rigid support frame 71 formed from a molded plastic material and having a leading or front shelf portion 77 configured to hold numerous objects within trough 77' such as drinks, containers, etc. Alternately, the rigid support frame 71 could be fabricated other than by molding from plastic and could be structured from a metal, fiberglass or any other like rigid material. In this embodiment, the rigid frame 71 includes an upper peripheral portion disposed in totally surrounding relation to the entrance to the contained space 18 and at least partially defining such entrance. A plurality of leg elements 74 are mounted in engaging relation with a designated ground or supporting surface 11 and have a sufficient longitudinal dimension to maintain the surrounding rigid support frame 71 in upstanding, spaced apart relation to the surface 11 on which the platform 14 is positioned. In this embodiment as well as the other embodiments as discussed in FIGS. 5 through 10, the containment means 22 includes containment wall 23' interconnected about the periphery as at 24 and 24' to the platform 14 of base means 12 and extending along a major portion of the length thereof. The containment wall 23' extends upwardly from the periphery as at 24 and 24' to supported interconnection with the rigid support frame 71. This connection is accomplished by overlapping flaps 78 dimensioned and configured to extend above the upper peripheral surface and be secured thereto by a plurality of studs or outwardly extending cleat members 80. The cleats 80 are integrally or fixedly secured to the support frame 71 and designed to engage flaps 78 through a plurality of correspondingly positioned apertures formed therein. Other connecting structure could of course be utilized to supportingly engage flaps 78 with support frame 71. By virtue of this configuration, the contained space 18 is defined by the surrounding containment wall 23' and also by the exposed surface of a backrest portion 82.

This backrest portion 82 may be formed by an extension from one end of the platform 14 and exist on all embodiments of the present invention. The backrest 82 is disposed in spaced relation to the ground or supporting surface 11 and is angled upwardly from its interconnection with the platform 14 to a supported position adjacent the neck bolster 35 and in engageable relation with the rigid frame member 71, 71' and 71'' as set forth in FIGS. 5 through 10. FIG. 1 shows backrest 82 secured preferably integrally with inflatable sections 28 and 30.

Figure 7:
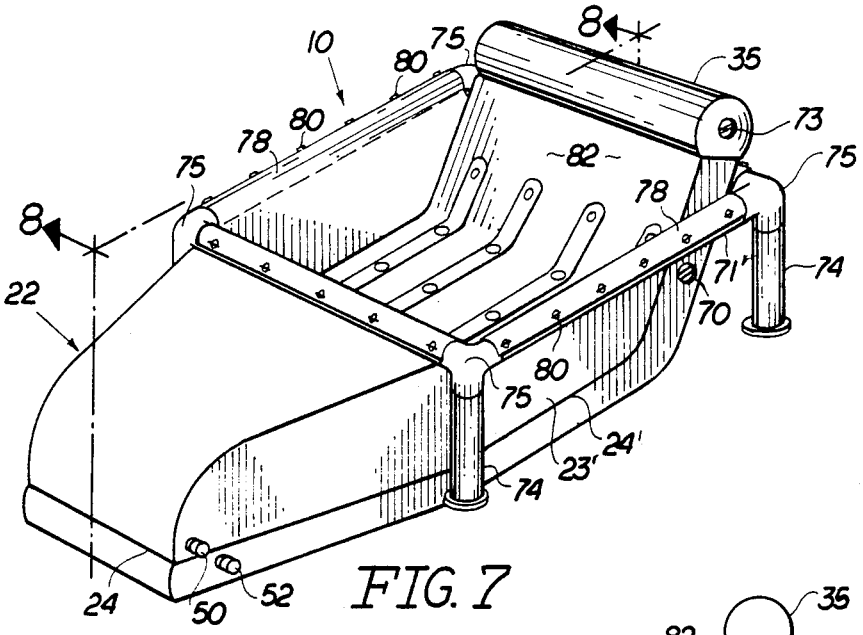
FIG. 7 is an isometric view of yet another embodiment of the present invention incorporating a rigid support frame.
Figure 8:
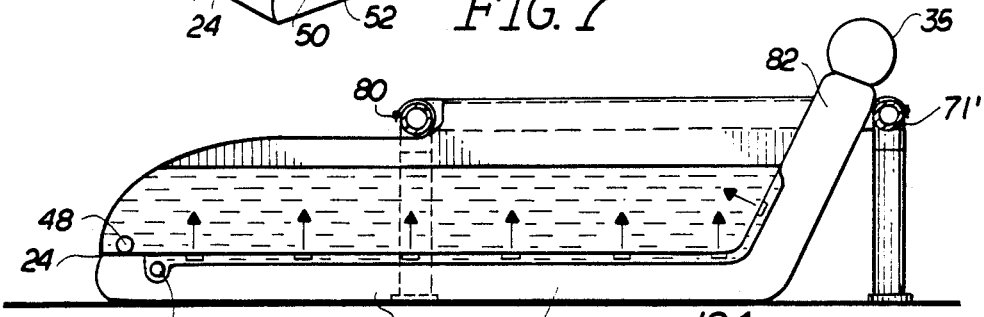
FIG. 8 is a sectional view taken along 8—8 of FIG. 7.

With regard to the embodiments of FIGS. 7, 8 and 9, 10, the primary difference is in the structure of the rigid support frame 71' and 71'' and the supporting legs 74. In the embodiment of FIGS. 7 and 8, the support frame 71'' and the supporting legs 74 are made from a hollow pipe structure formed of polyvinylchloride (PVC) which is commercially available. Similarly, the joints 75 may be fixedly or removably connected to one another so as to facilitate breakdown of the entire spa assembly and storage thereof.

Figure 9:
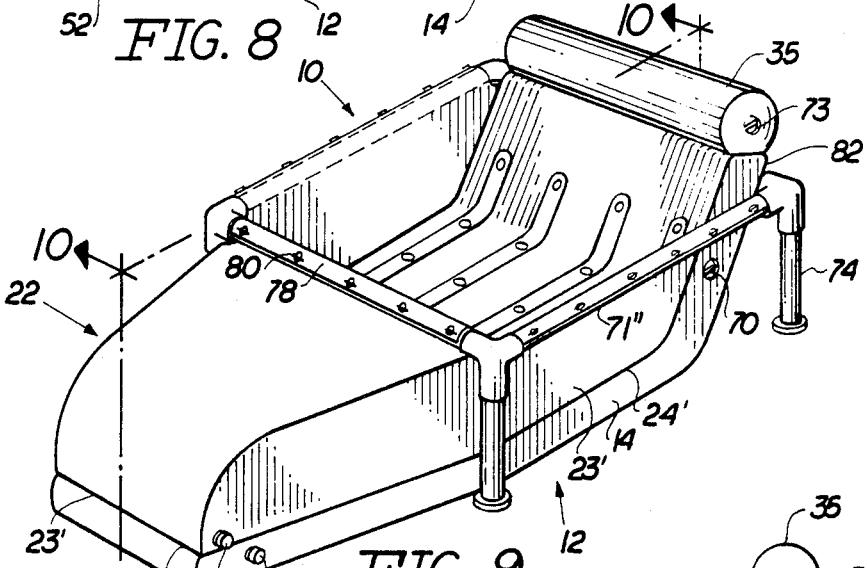
FIG. 9 is an isometric view of yet another embodiment of the present invention showing the rigid support frame formed of various materials.
Figure 10:
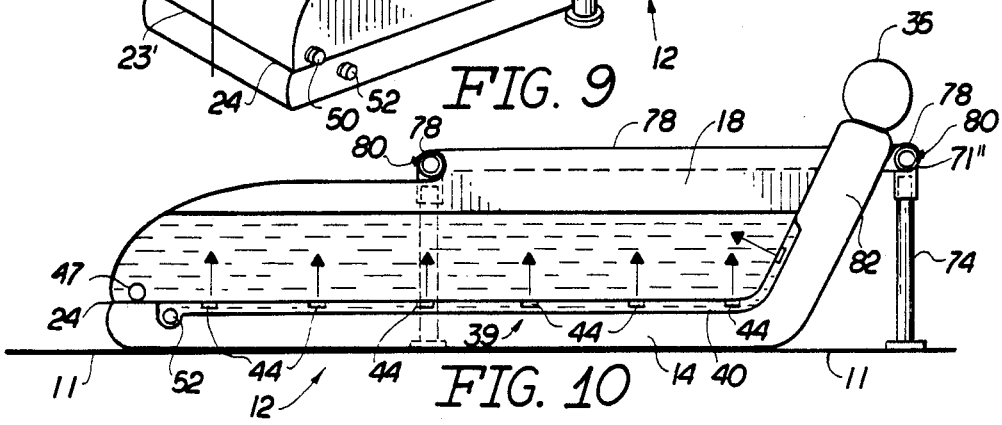
FIG. 10 is a sectional view along line 10—10 of FIG. 9.

With regard to the embodiment of FIGS. 9 and 10, the rigid support frame 71'' is made from a rigid metallic material with a chrome or like decorative material coating or plating thereon wherein the leg portions 74 are also appropriately formed from a metal having a chrome plating formed thereon in order to add to the aesthetic appearance of the support frame 71".

It is therefore to be understood that the following claims are intended to cover all of the intended and specific features of the present invention herein described, and all statements of the scope of the invention which as a matter of language might be said to fall therebetween.

What is claimed is:

1. A portable spa assembly of the type primarily designed to be collapsible and being dimensioned and structured to accommodate a plurality of occupants within a contained area being also at least partially filled with water, said assembly comprising:

(a) base means dimensioned to extend along a length of said assembly and configured and disposed for supporting relation to occupants within said assembly, (b) said base means being inflatable and defining a platform disposed along its length on a support surface and structured for orientation between an expanded, operable position and a collapsed, storable position.

(c) containment means secured to said base means and extendable upwardly therefrom in at least partially surrounding relation to an exposed surface of said platform and disposed and configured to at least partially define a contained area within said assembly and above said platform, (d) a support means for supporting said assembly in said operable position and comprising a rigid support frame including a plurality of spaced apart upstanding support legs collectively resting on the supporting surface and including a plurality of peripheral portions connected between correspondingly positioned opposite ends of said support legs.

(e) said peripheral portions formed of rigid material and disposed in surrounding relation to and at least partially defining an opening of said contained area, said opening dimensioned and configured to define an entrance for a plurality of occupants into said contained area, (f) said base means further including an inflatable backrest portion secured to said platform at one end thereof and disposed in exposed relation to said entrance, (g) said backrest portion extending upwardly and outwardly from said one end of said platform in an angularly inclined position in spaced relation to the supporting surface and into secured and supporting engagement with one of said peripheral portions of said support means, said platform having a substantially elongated configuration and an opposite end thereof disposed beyond said support means, (h) said platform extending between two of said plurality of support legs and beneath one of said peripheral portions supported between said two legs so as to terminate at said opposite end, (i) said containment means comprising a containment wall formed of flexible, liquid impermeable material and connected continuously along a major length of a peripheral edge of said platform and extending upwardly therefrom into supported engagement with said support means, (j) said containment wall further structured and configured to extend upwardly and inwardly from said opposite end of said platform into supported engagement with said one peripheral portion contiguous said entrance, (k) said containment wall disposed in covering relation to a portion of said platform from said opposite end to said support means and in containing engagement with water overlying said platform portion within said contained area, (l) fluid directing means mounted on said base means and structured to direct fluid flow upwardly from an exposed surface of said platform into said contained area, (m) fluid regulating means interconnected in fluid communication with said fluid directing means and a liquid supply and including a pump means disposed and structured to force water flow into and out of said contained space, and (n) whereby said contained space may be at least partially filled with water for at least partial submerging of occupants therein.

2. An assembly as in claim 1 wherein said fluid directing means includes a conduit means interconnected in liquid receiving relation to said fluid regulating means and mounted on said exposed surface of said platform and including a plurality of jet apertures disposed in spaced relation to one another and structured to direct liquid flow outwardly from said exposed surface into said contained space.

3. An assembly as in claim 2 wherein said conduit means is configured to include predetermined conduit portions extending over a major portion of said exposed surface and including said plurality of jet apertures formed in each of said conduit portions, whereby liquid is directed upwardly from major portion of said exposed surface into said contained space.

4. An assembly as in claim 1 wherein said backrest portion and said platform are integrally constructed and attached to one another, said backrest portion angularly inclined to extend from said one end of said platform through said entrance and into supported and securable relation with said peripheral portion along a rear surface of said backrest portion.

5. An assembly as in claim 4 further comprising an inflatable bolster structure connected to and extending along an outer peripheral end of said backrest portion opposite to said platform and above and beyond said peripheral portion to which said backrest portion is attached.

6. An assembly as in claim 1 wherein said plurality of support legs are detachably connected to said plurality of peripheral portions, said support means structured to be disassembled into a storable, portable condition.

7. An assembly as in claim 1 wherein said fluid regulating means comprises a pump means for directing water to and from said contained area and disposed in interconnected fluid communication between a conventional supply of water and said fluid directing means; valve means for controlling water flow and structured to direct water flow between said pump means and said fluid directing means and into and out of said contained area; heater means structured for heating water flow passing therethrough and further disposed in fluid communication between said pump means and said fluid directing means, whereby water entering said contained area through said fluid directing means may be heated to a predetermined degree.

8. An assembly as in claim 7 further comprising drain means for removing water from said contained area and mounted in fluid communication within the interior of said contained area and further interconnected to said pump means, said drain means, pump means and valve means all cooperatively structured and interconnected to selectively direct water flow into said contained area from said fluid directing means and from said contained area through said drain means.

* * * * *